US007379073B2

(12) United States Patent
Park et al.

(10) Patent No.: US 7,379,073 B2
(45) Date of Patent: May 27, 2008

(54) METHOD OF RESTORING RGB GRAY SCALE DATA AND APPARATUS FOR PERFORMING THE SAME

(75) Inventors: Dong-Chul Park, Yongin-si (KR); Yong-Guen Ku, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 686 days.

(21) Appl. No.: 10/933,798

(22) Filed: Sep. 3, 2004

(65) Prior Publication Data

US 2005/0062764 A1 Mar. 24, 2005

(30) Foreign Application Priority Data

Sep. 22, 2003 (KR) ..... 10-2003-0065637

(51) Int. Cl.
*G09G 5/04* (2006.01)

(52) U.S. Cl. ..... 345/600; 345/531; 345/601; 345/602; 345/603; 345/605

(58) Field of Classification Search ..... 345/531, 345/600, 601, 602, 603, 605, 619
See application file for complete search history.

(56) References Cited

U.S. PATENT DOCUMENTS 5,231,543 A * 7/1993 Kubota et al. ..... 386/90
5,469,190 A * 11/1995 Masterson ..... 345/605
5,485,393 A * 1/1996 Bradford ..... 702/60
5,586,203 A * 12/1996 Spaulding et al. ..... 382/270
5,877,754 A * 3/1999 Keith et al. ..... 345/601
6,127,965 A * 10/2000 McDade et al. ..... 342/159
6,394,573 B1 * 5/2002 Lapstun et al. ..... 347/19
2002/0089701 A1 * 7/2002 Lu et al. ..... 358/443
2002/0191221 A1 * 12/2002 Cooper ..... 358/3.13

* cited by examiner

*Primary Examiner*—Bipin Shalwala
*Assistant Examiner*—Vincent E. Kovalick
(74) *Attorney, Agent, or Firm*—F.Chau & Associates, LLC

(57) ABSTRACT

A method of restoring RGB gray scale data for maintaining a sharpness of a screen and reducing a size of a memory is disclosed. The RGB gray scale data having M bits are truncated to generate a first RGB gray scale data having N bits, M being a positive integer and N being an integer less than M. RGB gray scale data information is generated based on a bit information of the first RGB gray scale data. A bit value of a MSB of the first RGB gray scale data is compared with a value of a dither table based on the RGB gray scale data information to generate a comparison value, when a bit value of at least one bit of the first RGB gray scale data is different from other bit values of the first RGB gray scale data. The first RGB gray scale data are compensated based on the RGB gray scale data information and the comparison value. Thus, the sharpness of a screen may be maintained and the size of the memory may be reduced.

38 Claims, 13 Drawing Sheets

METHOD OF RESTORING RGB GRAY SCALE DATA AND APPARATUS FOR PERFORMING THE SAME

CROSS-REFERENCE TO RELATED APPLICATIONS

This application claims priority from Korean Patent Application No. 2003-65637, filed on Sep. 22, 2003, the contents of which are incorporated herein by reference in its entirety.

1. Technical Field

The present invention relates to display devices, and, more particularly, a method and apparatus for restoring RGB gray scale data in display devices.

2. Discussion of The Related Art

A conventional display device employed in mobile applications has a memory, which has a storage capacity for storing M bits of data so as to transfer RGB gray scale data having M bits (M is a positive integer) to a display. As mobile devices become smaller in size, the size of the memory is also reduced. To maintain the sharpness of an image, an apparatus for restoring the RGB gray scale data may be used such that the RGB gray scale data having M bits are transferred with minimum data loss to the display. The apparatus for restoring RGB gray scale data truncates at least one bit from the RGB gray scale data. The truncated RGB gray scale data having N bits (N is less than M) is stored in the smaller memory. Then, the apparatus for restoring RGB gray scale data compensates for the truncated RGB gray scale data, and generates a first RGB gray scale data, i.e. compensated RGB gray scale data. Then, the first RGB gray scale data is transferred to the display.

According to the conventional apparatus for restoring the RGB gray scale data, a value of an LSB (Least Significant Bit) of the first RGB gray scale data is equal to a value of a MSB (Most Significant Bit) of the RGB gray scale data. As a result, when the first RGB gray scale data are transferred to the display, the display device may be brighter or darker than the original brightness. That is, the sharpness of a screen may decrease. Hence, a need exists for an apparatus for restoring the RGB gray scale data that is capable of increasing the sharpness of a screen.

SUMMARY OF THE INVENTION

In accordance with one aspect of the present invention, there is provided a method of restoring RGB gray scale data. The method includes truncating the RGB gray scale data having M bits to generate a first RGB gray scale data having N bits, M being a positive integer and N being an integer less than M; generating a RGB gray scale data information based on a bit information of the first RGB gray scale data; comparing a bit value of a MSB (most significant bit) of the first RGB gray scale data with a value of a dither table based on the RGB gray scale data information to generate a comparison value, when a bit value of at least one bit of the first RGB gray scale data is different from other bit values of the first RGB gray scale data; and compensating for the first RGB gray scale data based on the RGB gray scale data information and the comparison value to generate a second RGB gray scale data.

Another method of restoring RGB gray scale data is provided. The method includes truncating a first RGB gray scale data having M bits to generate a second RGB gray scale data having N bits, M being a positive integer and N being an integer less than M; storing the second RGB gray scale data; generating a RGB gray scale data information based on a bit information of the second gray scale data; comparing a bit value of a MSB of the second RGB gray scale data with a value of a dither table based on the RGB gray scale data information to generate a comparison value, when a bit value of at least one bit of the second RGB gray scale data is different from other bit values of the second RGB gray scale data; and compensating for the second RGB gray scale data based on the RGB gray scale data information and the comparison value to generate a third RGB gray scale data.

In accordance with another aspect of the present invention, there is provided an apparatus for restoring RGB gray scale data. The apparatus includes a data input section configured to generate a RGB gray scale data information based on a bit information of a first RGB gray scale data having N bits, the first RGB gray scale data being obtained by truncating RGB gray scale data having M bits, M being a positive integer and N being an integer less than M; a comparing section configured to compare a MSB of the first RGB gray scale data with a value of a dither table based on the RGB gray scale data information to generate a comparison value; and a data restoring section configured to compensate for the first RGB gray scale data based on the RGB gray scale data information and the comparison value to restore a bit number of the first RGB gray scale data to generate a second RGB gray scale data having M bits.

Another apparatus for restoring RGB gray scale data is provided. The apparatus includes a bit truncating section configured to truncate a first RGB gray scale data having M bits to generate a second RGB gray scale data having N bits, M being a positive integer, and N being an integer less than M; a memory configured to store the second RGB gray scale data; and a bit restoring section configured to generate a RGB gray scale data information based on a bit information of the second RGB gray scale data, configured to generate a comparison value by comparing a MSB of the first RGB gray scale data with a value of a dither table, and configured to compensate for the second RGB gray scale data based on the RGB gray scale data information and the comparison value to generate a third RGB gray scale data having M bits.

BRIEF DESCRIPTION OF THE DRAWINGS

The above and other features of the present invention will become readily apparent by reference to the following detailed description when considered in conjunction with the accompanying drawings wherein.

DESCRIPTION OF EMBODIMENTS

Hereinafter, the exemplary embodiments of the present invention will be explained in more detailed with reference to the accompanying drawings.

An apparatus for restoring RGB gray scale data may be employed in an LCD (Liquid Crystal Display) driver integrated circuit used for mobile applications. Size of a graphic memory may be reduced when the RGB gray scale data are compensated using the apparatus for restoring RGB gray scale data. Hereinafter, for illustrative purposes, it is assumed that a first RGB (red, green, and blue) data have 18 bits in a unit of a pixel and the memory has a storage capacity for storing 16 bits of data in a unit of a pixel. However, it is understood that the first RGB gray scale data may have varying lengths other than 18 bits.

Figure 1:
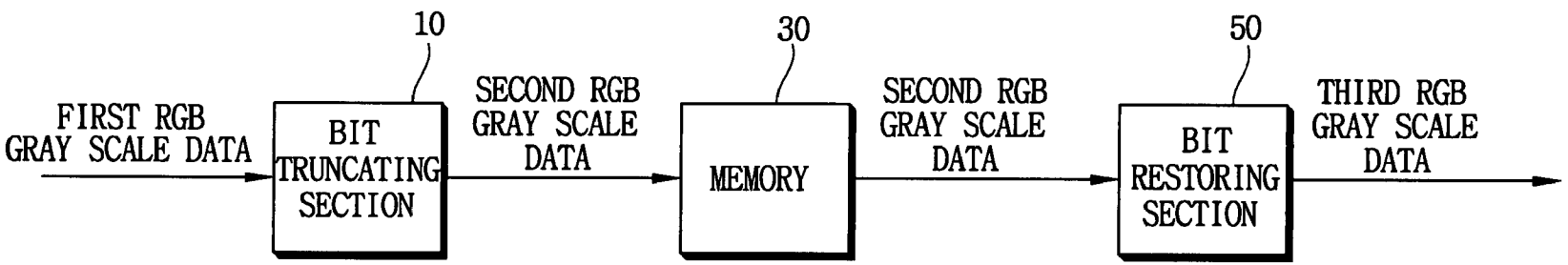
FIG. 1 is a block diagram illustrating an apparatus for restoring RGB gray scale data according to an exemplary embodiment of the present invention.

FIG. 1 is a block diagram illustrating an apparatus for restoring RGB gray scale data according to an exemplary embodiment of the present invention.

Referring to FIG. 1, the apparatus for restoring RGB gray scale data includes a bit truncating section 10, a memory 30 and a bit restoring section 50.

The bit truncating section 10 receives the first RGB gray scale data and generates a second RGB gray scale data. Particularly, the bit truncating section 10 receives the first RGB gray scale data and truncates at least one bit of the received first RGB gray scale data to generate the second RGB gray scale data.

For example, the first RGB gray scale data may have 18 bits, and the second RGB gray scale data may have 16 bits. Thus, the first RGB gray scale data need to be truncated because the memory 30 has a maximum storage capacity for storing 16 bits of RGB gray scale data. The first RGB gray scale data may include 6-bit data corresponding to a red color, 6-bit data corresponding to a green color, and 6-bit data corresponding to a blue color. However, for example, the second RGB gray scale data may include 5-bit data corresponding to the red color, 6-bit data corresponding to the green color, and 5-bit data corresponding to the blue color. In other words, in the present exemplary embodiment, the bit truncating section 10 respectively truncates one bit of the data corresponding to the red color and the blue color. However, it is understood that the bit truncating section 10 may truncate N (an integer equal to or greater than 2) bits of the data corresponding to the red, green and blue colors. The memory 30 stores the second RGB gray scale data. Particularly, the memory 30 stores the second RGB gray scale data having 16 bits in correspondence with a memory address. Based on the memory address, a dither table (not shown) may be generated.

The memory 30 has a size corresponding to a size of a display panel (not shown). Generally, a display panel employed in mobile applications displays 260,000 colors, which correspond to 240×18×320 bits. The size of the memory 30 is 1,228,800 (or 240×16×320) bits. In other words, although the display panel is different from the memory 30 in view of bits, there is a one-to-one correspondence between the address of the graphic memory (not shown) and the address of the memory 30. Particularly, 1×1 address of the memory 30 corresponds to 1×1 address of the display panel. Therefore, when the second RGB gray scale data stored in 1×1 address of the memory 30 is read and compensated, a pixel corresponding to 1×1 address of the display panel is selected so as to display a color.

The bit restoring section 50 receives the second RGB gray scale data, and discriminates bit information of the received second RGB gray scale data. Particularly, the bit restoring section 50 discriminates whether all the bit values of data corresponding to a first color of the received second RGB gray scale data have binary values '1', or have binary values '0'. For example, when the data corresponding to the first color have 5 bits, the bit restoring section 50 discriminates whether the data corresponding to the first color has '11111' or '00000'. For example, the first color may be a red or a blue.

The bit restoring section 50 generates RGB gray scale data information based on the discrimination operation. The RGB gray scale data information includes the bit values of the data corresponding to the first color of the received second RGB gray scale data. When a bit value of at least one bit of the second RGB gray scale data is different from other bit values of the second RGB gray scale data, the bit restoring section 50 compares a MSB (most significant bit) of the second RGB gray scale data with a value of the dither table to generate a comparison value. In addition, the bit restoring section 50 compensates for a bit number of the second RGB gray scale data based on the comparison value and the RGB gray scale data information. As a result, a third RGB gray scale data having 18 bits is generated. In other words, the bit restoring section 50 restores the bit number (e.g. 18) of the first RGB gray scale data.

An apparatus for restoring RGB gray scale data of the present invention compensates for the bit number of the second RGB gray scale data by comparing a bit value of the second RGB gray scale data with a value of the dither table, thereby maintaining sharpness of a screen and reducing the size of the memory 30.

Figure 2:
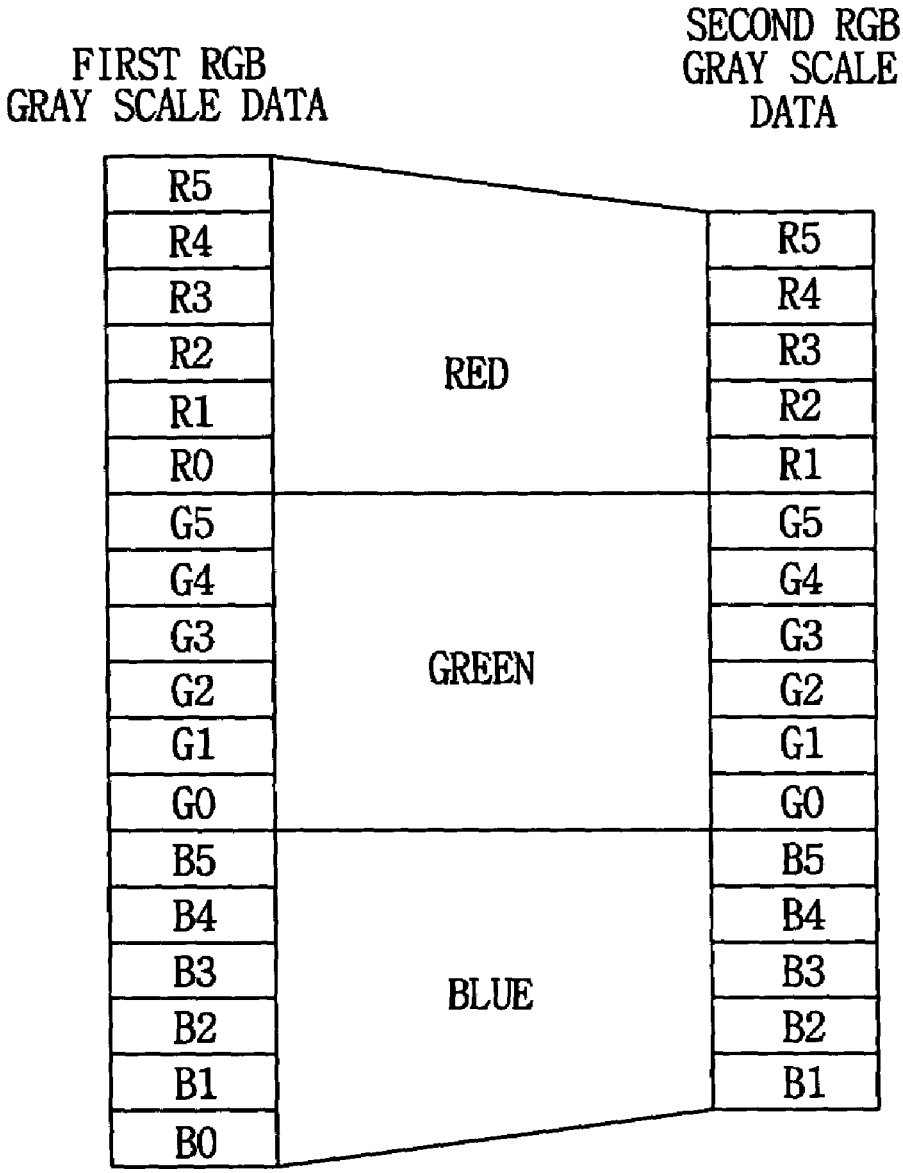
FIG. 2 is a schematic diagram illustrating RGB gray scale data according to an exemplary embodiment of the present invention.

FIG. 2 is a schematic diagram illustrating RGB gray scale data according to an exemplary embodiment of the present invention.

Referring to FIG. 2, the first RGB gray scale data according to an exemplary embodiment of the present invention have 18 bits. Particularly, the first RGB gray scale data include 6-bit data corresponding to a red (R5~R0), 6 bit-data corresponding to a green (G5~G0) and 6-bit data corresponding to a blue (B5~B0). The R5 is a MSB of the 6-bit data corresponding to the red. The G5 is a MSB of the 6-bit data corresponding to the green. The B5 is a MSB of the 6-bit data corresponding to the blue. The R0 is an LSB of the 6-bit data corresponding to the red. The G0 is an LSB of the 6-bit data corresponding to the green. The B0 is an LSB of the 6-bit data corresponding to the blue.

The second RGB gray scale data according to an exemplary embodiment of the present invention have 16 bits. The second RGB gray scale data include 5-bit data corresponding to the red (R5~R1), 6-bit data corresponding to the green (G5~G0) and 5-bit data corresponding to the blue (B5~B1). As shown in FIG. 2, the second RGB gray scale data does not include the LSB 'R0' of the data corresponding to the red and the LSB 'B0' of the data corresponding to the blue, as shown in the first RGB gray scale data. In other words, the R0 and the B0 of the first RGB gray scale data are truncated. Since the green color generally has the greatest effect on a brightness of a screen among the red, green and blue colors, the LSBs corresponding to the red and the blue of the first RGB gray scale data are truncated.

Figure 3:
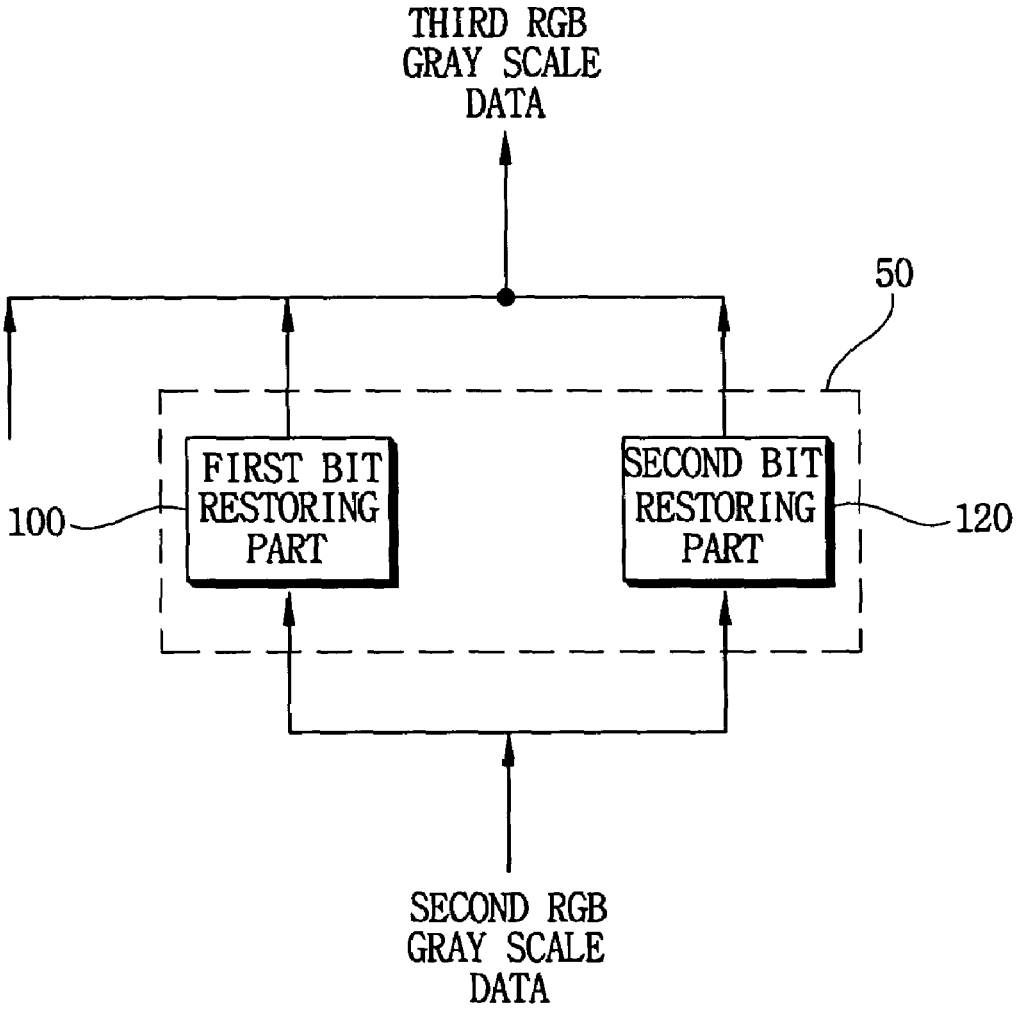
FIG. 3 is a block diagram illustrating a bit restoring section according to an exemplary embodiment of the present invention.

FIG. 3 is a block diagram illustrating a bit restoring section according to an exemplary embodiment of the present invention.

Referring to FIG. 3, the bit restoring section 50 includes a first bit restoring part 100 and a second bit restoring part 120.

The first bit restoring part 100 compensates for the data corresponding to the red, thereby restoring its bit number of the second RGB gray scale data to 6. The second bit restoring part 120 compensates for the data corresponding to the blue, thereby restoring its bit number of the second RGB gray scale data to 6.

That is, the third RGB gray scale data include 6-bit data corresponding to the red, 6-bit data corresponding to the green and 6-bit data corresponding to the blue. Only the values of the restored LSB bits of the third RGB gray scale data may be different from that of the LSB bits of the first RGB gray scale data. In other words, although the R0 and B0 of the first RGB gray scale data are restored in view of a bit number, the R0 and B0 may not be restored in view of a bit value.

Figure 4:
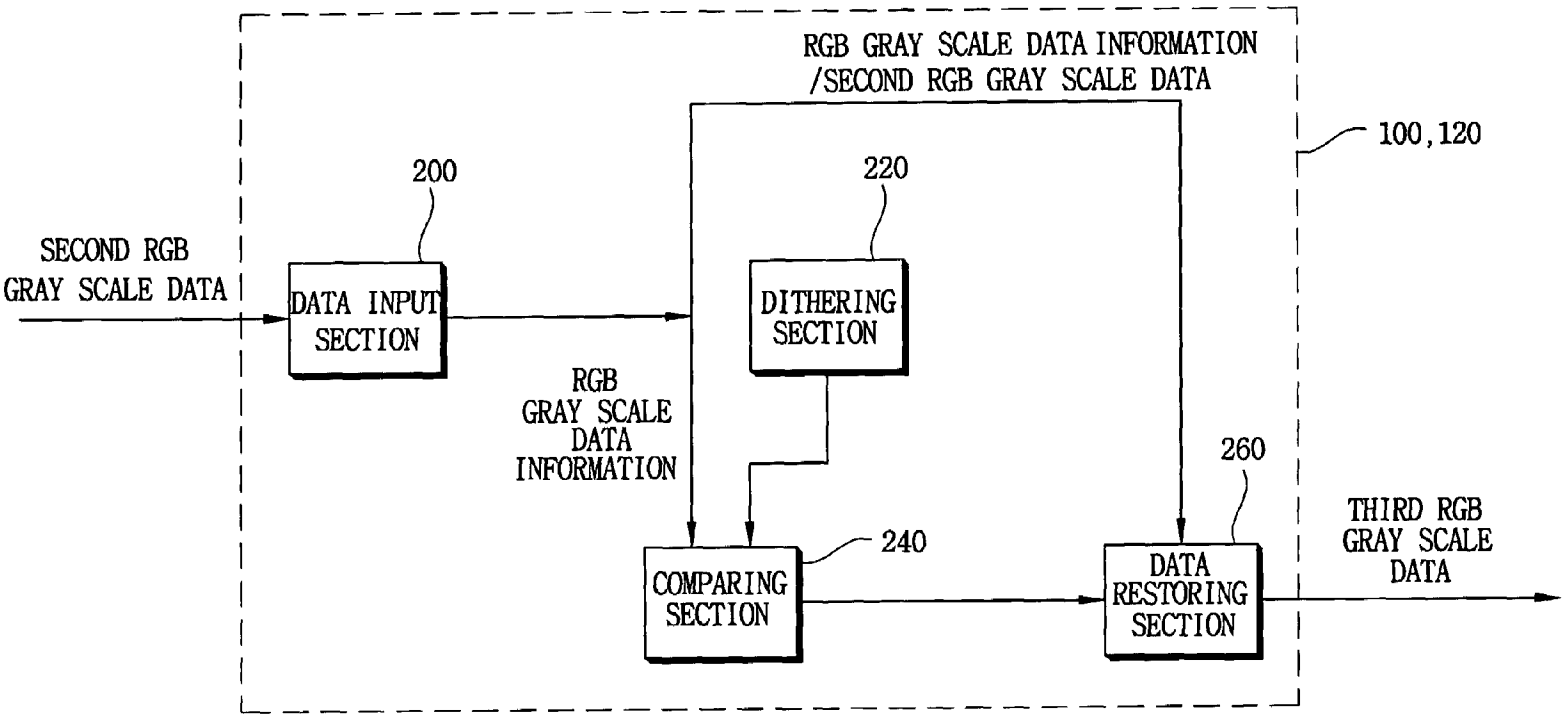
FIG. 4 is a block diagram illustrating first and second bit restoring sections according to an exemplary embodiment of the present invention.

FIG. 4 is a block diagram illustrating first and second bit restoring sections according to an exemplary embodiment of the present invention.

Since the second bit restoring part 120 according to an exemplary embodiment of the present invention is substantially identical to the first bit restoring part 100, only the first bit restoring part 100 will be described in detail, hereinafter. Referring to FIG. 4, the first bit restoring part 100 includes a data input section 200, a dithering section 220, a comparing section 240 and a data restoring section 260.

The data input section 200 receives the second RGB gray scale data. Particularly, the data input section 200 receives the 5-bit data corresponding to the red, and discriminates the bit information of the second RGB gray scale data. In other words, the data input section 200 discriminates whether all the bit values of the data corresponding to the red have binary values '0', or have binary values '1', thereby generating RGB gray scale data information. For example, the data discriminating section 300 discriminates whether R5~R1 have binary value '11111' or '00000'.

The dithering section 220 includes information concerning the dither table (not shown), and transmits the information to the comparing section 240.

When a bit value of at least one bit of the second RGB gray scale data is different from other bit values of the second RGB gray scale data, the comparing section 240 compares a MSB of the second RGB gray scale data with a value of the dither table based on the RGB gray scale data information. In addition, the comparing section 240 transmits a comparison value to the data restoring section 260 based on the comparison. When a bit value of the MSB of the second RGB gray scale data is substantially identical to the value of the dither table, the comparison value has a binary value '1'. Whereas, when the bit value of the MSB of the second RGB gray scale data is not substantially identical to the value of the dither table, the comparison value has a binary value '0'.

The data restoring section 260 compensates for the second RGB gray scale data, based on the RGB gray scale data information and the comparison value, thereby restoring the bit number to 18.

Figure 5:
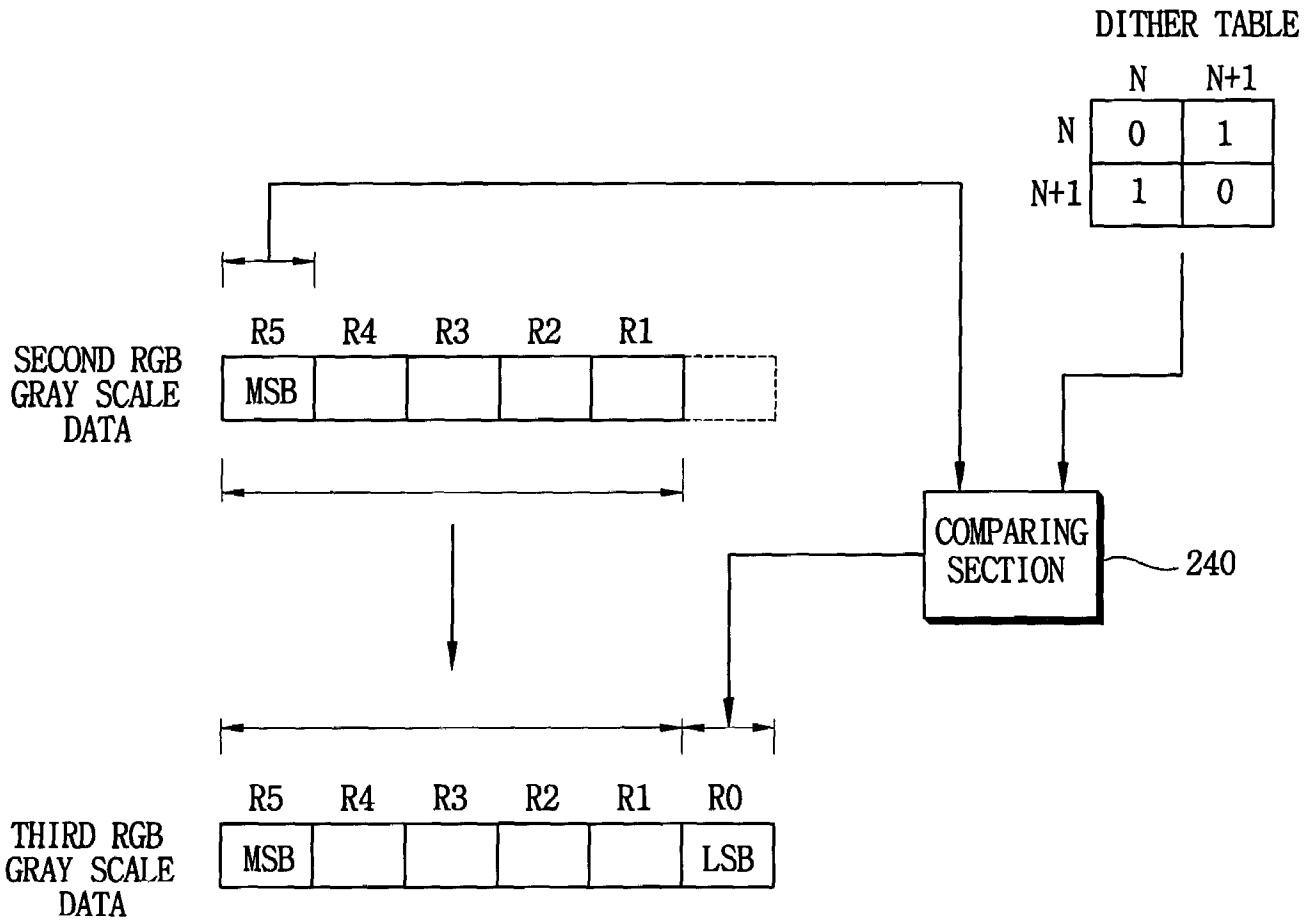
FIG. 5 is a schematic diagram illustrating an operation of a bit restoring section according to an exemplary embodiment of the present invention.

FIG. 5 is a schematic diagram illustrating an operation of a bit restoring section according to an exemplary embodiment of the present invention.

Hereinafter, for example, the second RGB gray scale data corresponds to red.

The bit value of the MSB of the second RGB gray scale data is compared with the value of the dither table when a bit value of at least one bit of the second RGB gray scale data is different from other bit values of the second RGB gray scale data. As a result, a comparison value is generated, and an LSB (R0) of the third RGB gray scale data has the comparison value. For example, when a bit value of the MSB of the second RGB gray scale data is substantially identical to a value of the dither table, the LSB of the third RGB gray scale data has the comparison value, e.g. a binary value '1'. Whereas, when a bit value of the MSB of the second RGB gray scale data is not identical to a value of the dither table, the LSB of the third RGB gray scale data has the comparison value, e.g. a binary value '0'. Particularly, when the bit value of the MSB of the second RGB gray scale data has a binary value '1' and the value of the dither table is a binary value '0', the bit value of the LSB of the third RGB gray scale data is a binary value '0'. Whereas, when the bit value of the MSB of the second RGB gray scale data is a binary value '1' and the value of the dither table is a binary value '1', the bit value of the LSB of the third RGB gray scale data is a binary value '1'.

Figure 6:
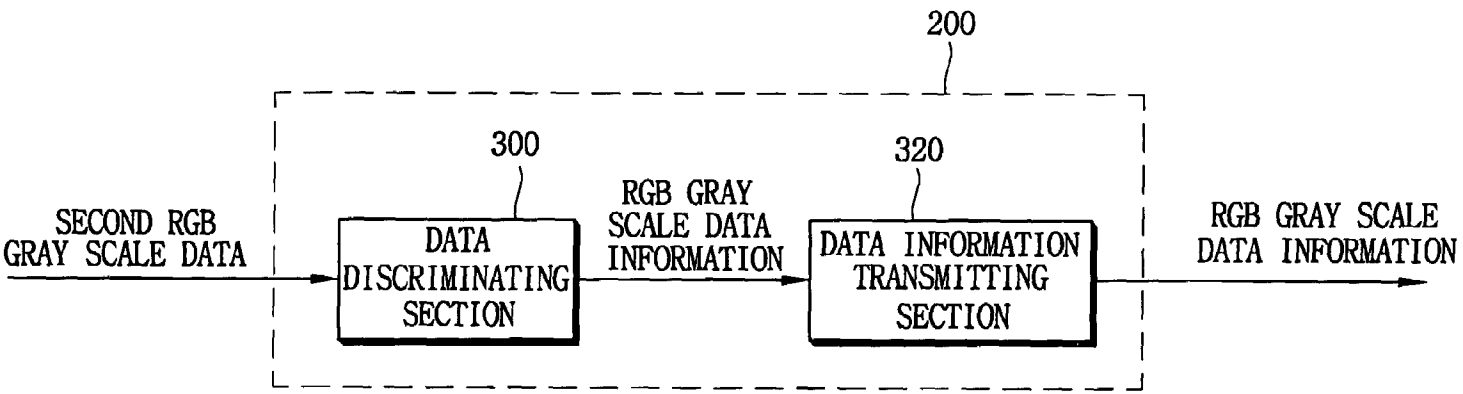
FIG. 6 is a block diagram illustrating a data input section according to an exemplary embodiment of the present invention.

FIG. 6 is a block diagram illustrating a data input section according to an exemplary embodiment of the present invention.

Referring to FIG. 6, the data input section 200 may include data discriminating section 300 and data information transmitting section 320.

The data discriminating section 300 discriminates bit information of the second RGB gray scale data to generate the RGB gray scale data information.

The data information transmitting section 320 receives the RGB gray scale data information, and transmits the received RGB gray scale data information to the comparing section 240 and the data restoring sections 260.

Figure 7A:
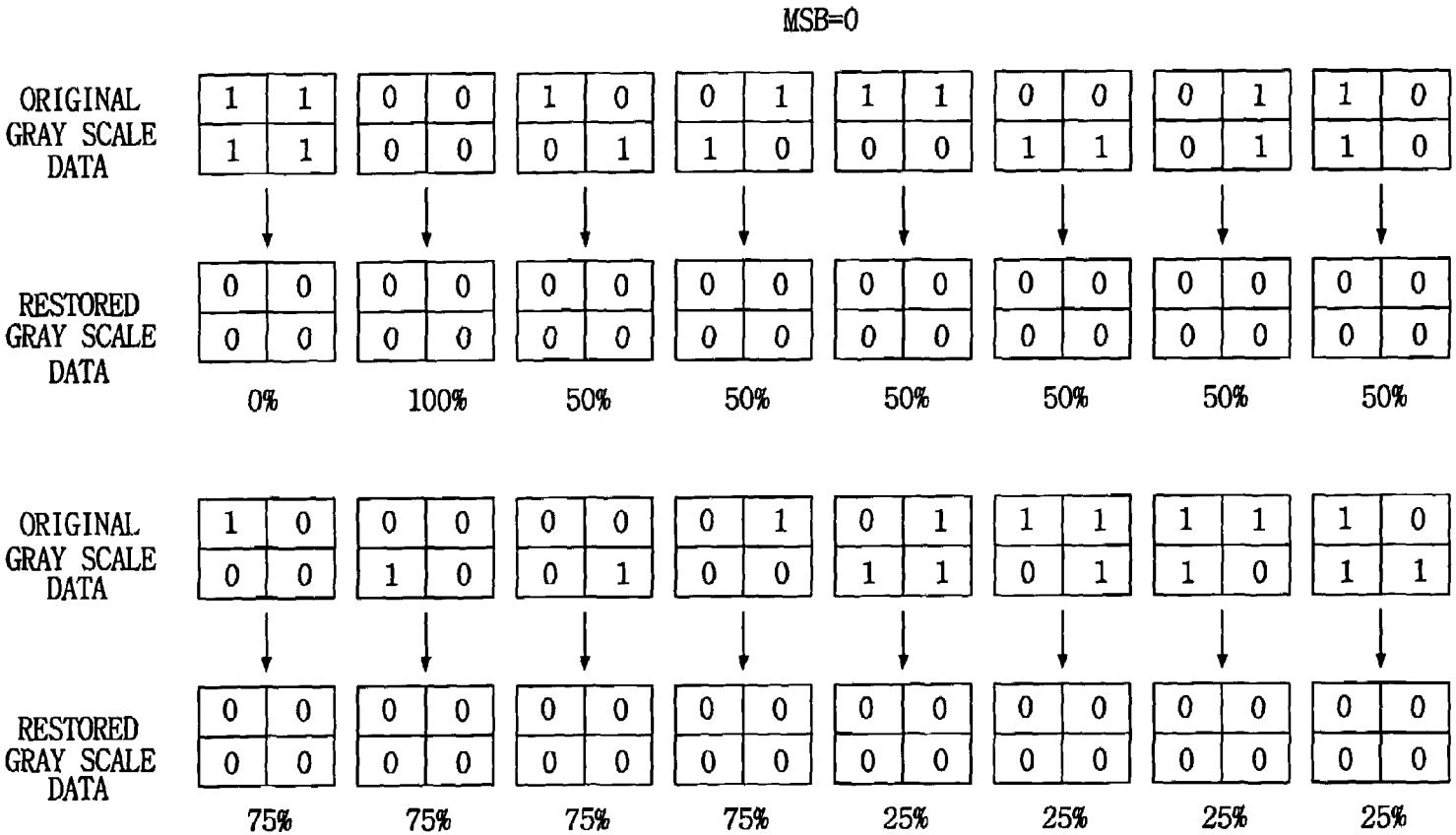
FIG. 7A (PRIOR ART)
FIG. 7A is a schematic diagram showing a conventional method of restoring RGB gray scale data.
Figure 8A:
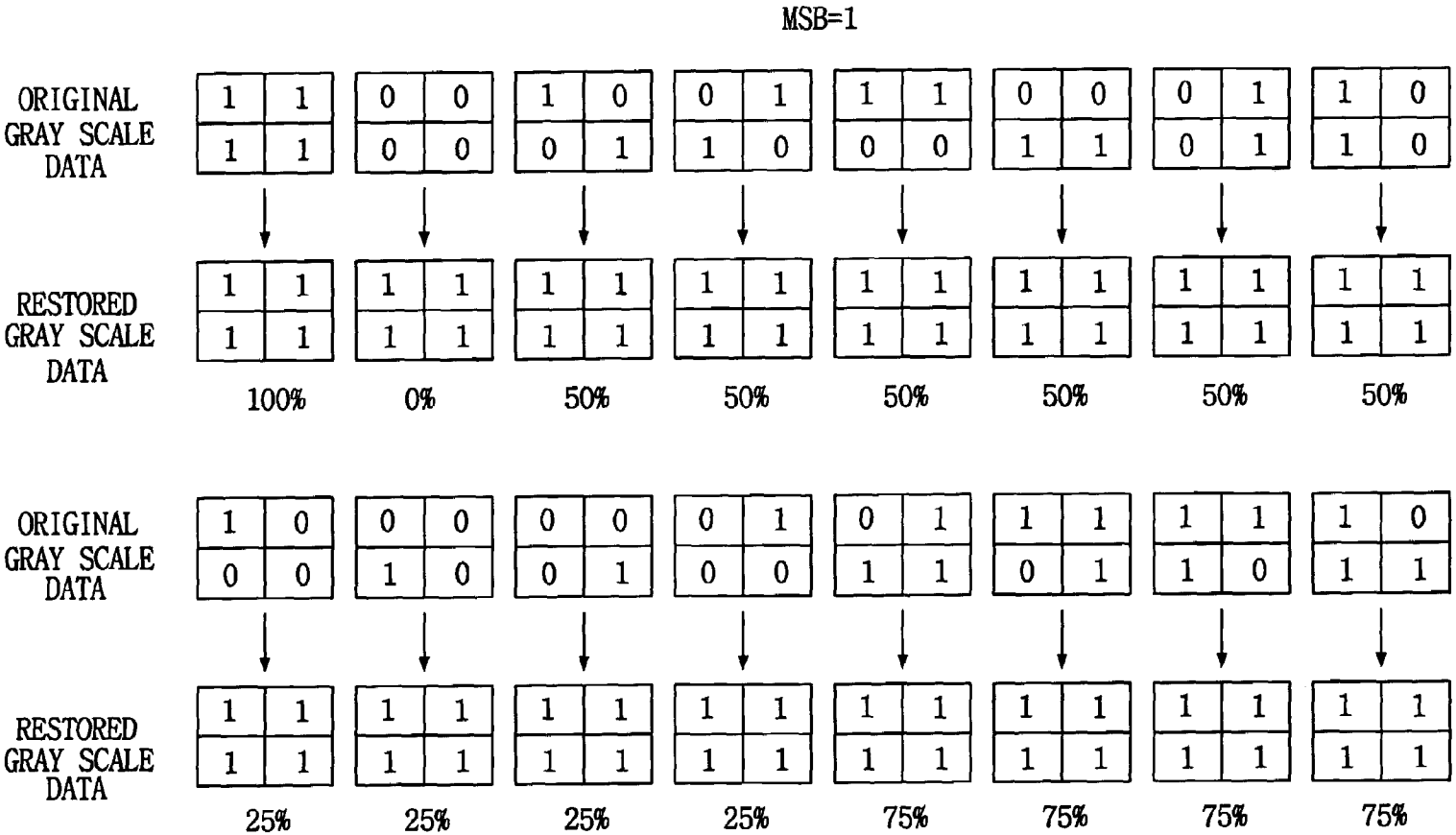
FIG. 8A (PRIOR ART)
FIG. 8A is a schematic diagram showing a conventional method of restoring RGB gray scale data.

FIG. 7A is a schematic diagram showing a conventional method of restoring RGB gray scale data, and FIG. 8A is a schematic diagram showing a conventional method of restoring RGB gray scale data.

It is assumed that a value of the MSB of RGB gray scale data is a binary value '0' in FIG. 7A, and a value of the MSB of RGB gray scale data is a binary value '1' in FIG. 8A.

Referring to FIG. 7A, a conventional apparatus for restoring RGB gray scale data compensates for the LSB of the restored RGB gray scale data based on the value of the MSB of the RGB gray scale data. As a result, when the MSB of the RGB gray scale data has a binary value '0', each of bit values of the LSB of the restored RGB gray scale data has the binary value '0'. Hence, the brightness of a displayed image using the restored RGB gray scale data is lower than that of a displayed image using an original RGB gray scale data. The RGB gray scale data may be exactly restored by a probability of about 50%.

Referring to FIG. 8A, a conventional apparatus for restoring the RGB gray scale data compensates for the LSB of the restored RGB gray scale data based on the value of the MSB of the RGB gray scale data. As a result, when the value of the MSB of the RGB gray scale data has a binary value '1', each of bit values of the LSB of the restored RGB gray scale data has the binary value '1'. Hence, the brightness of the displayed image using the restored RGB gray scale data is higher than that of a displayed image using the original RGB gray scale data.

In other words, when the value of the MSB of the RGB gray scale data has a binary value '1', the LSB of the restored RGB gray scale data has the binary value '1', and the brightness of a displayed image corresponding to the restored RGB gray scale data is higher than that of a displayed image corresponding to an original RGB gray scale data. In addition, when the MSB of the RGB gray scale data has a binary value '0', the LSB of the restored RGB gray scale data has the binary value '0', and the brightness of a displayed image corresponding to the restored RGB gray scale data is lower than that of a displayed image corresponding to an original RGB gray scale data. In addition, the RGB gray scale data may be exactly restored by a probability of about 50%.

Figure 7B:
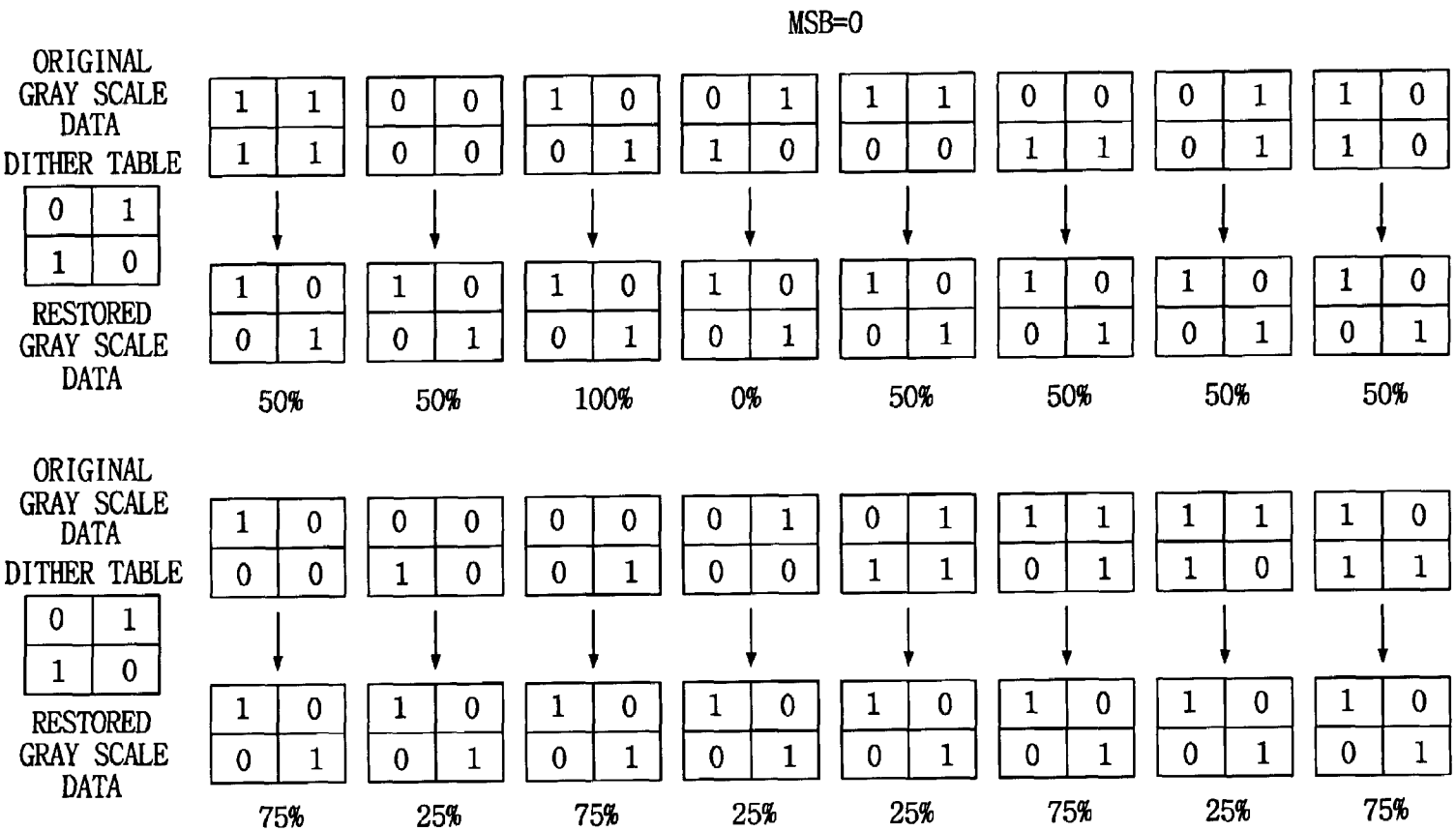
FIG. 7B is a schematic diagram showing a method of restoring RGB gray scale data according to an exemplary embodiment of the present invention.
Figure 8B:
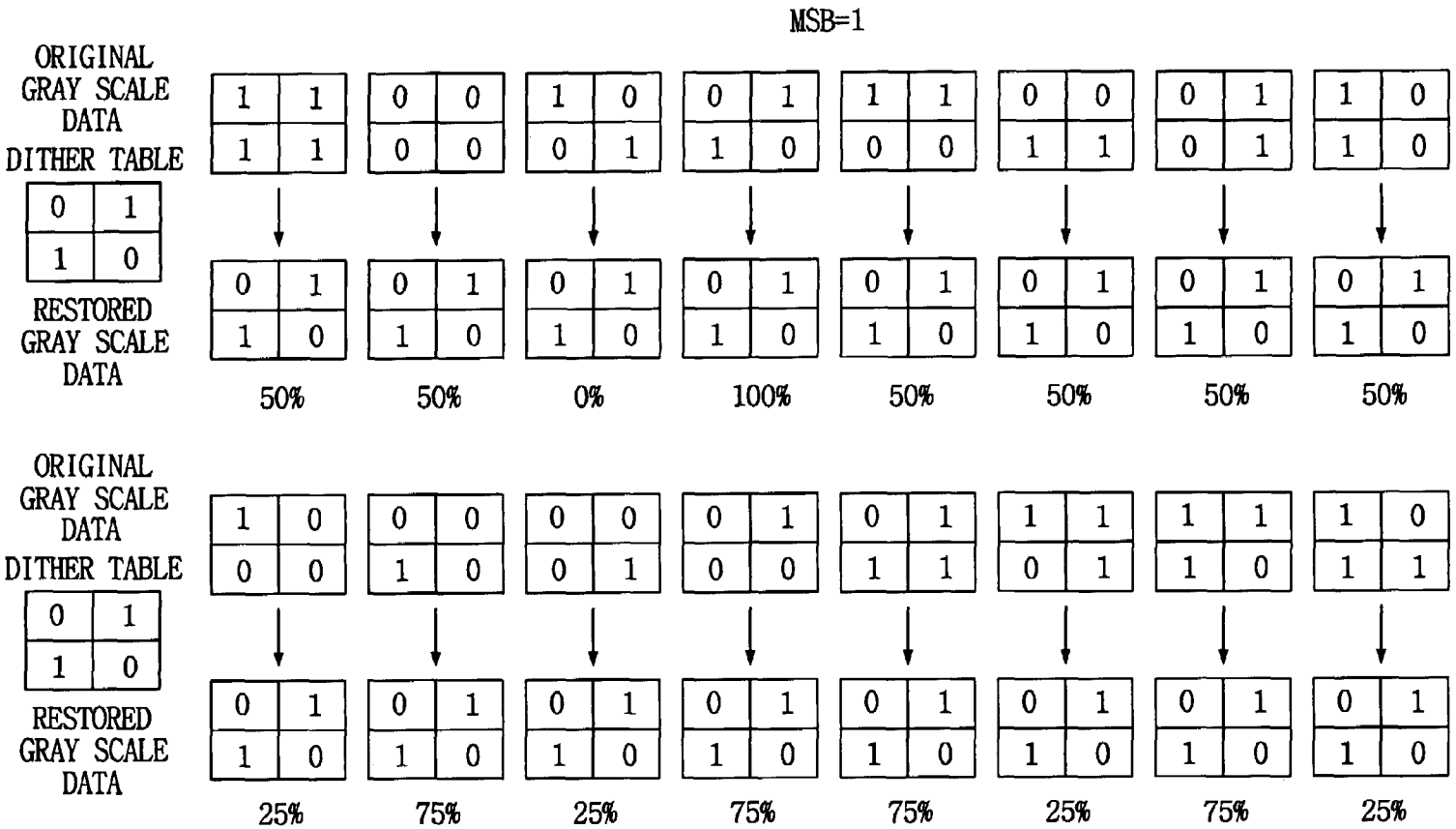
FIG. 8B is a schematic diagram showing a method of restoring RGB gray scale data according to an exemplary embodiment of the present invention.

FIG. 7B is a schematic diagram showing a method of restoring RGB gray scale data according to an exemplary embodiment of the present invention, and FIG. 8B is a schematic diagram showing a method of restoring RGB gray scale data according to an exemplary embodiment of the present invention.

It is assumed that a value of the MSB of the RGB gray scale data is a binary value '0' in FIG. 7B, and a value of the MSB of the RGB gray scale data is a binary value '1' in FIG. 8B.

Referring to FIG. 7B, there are 16 cases in which a value of the third RGB gray scale data (or the restored gray scale data) is larger than a value of corresponding first RGB gray scale data (or the original gray scale data), and there are 16 cases in which a value of the third RGB gray scale data is smaller than a value of the first RGB gray scale data. In other words, on average, the sharpness of the displayed image corresponding to the restored third RGB gray scale data is substantially identical to that of the displayed image corresponding to the first RGB gray scale data. Here, the RGB gray scale data may be exactly restored by a probability of about 50%.

Referring to FIG. 8B, there are 16 cases in which a value of the third RGB gray scale data (or the restored gray scale data) is larger than a value of corresponding first RGB gray scale data (or the original gray scale data), and there are 16 cases in which a value of the third RGB gray scale data is smaller than a value of the first RGB gray scale data. In other words, on average, the sharpness of the displayed image corresponding to the restored third RGB gray scale data is substantially identical to that of the displayed image corresponding to the first RGB gray scale data. Here, the RGB gray scale data may be exactly restored by a probability of about 50%.

Figure 9:
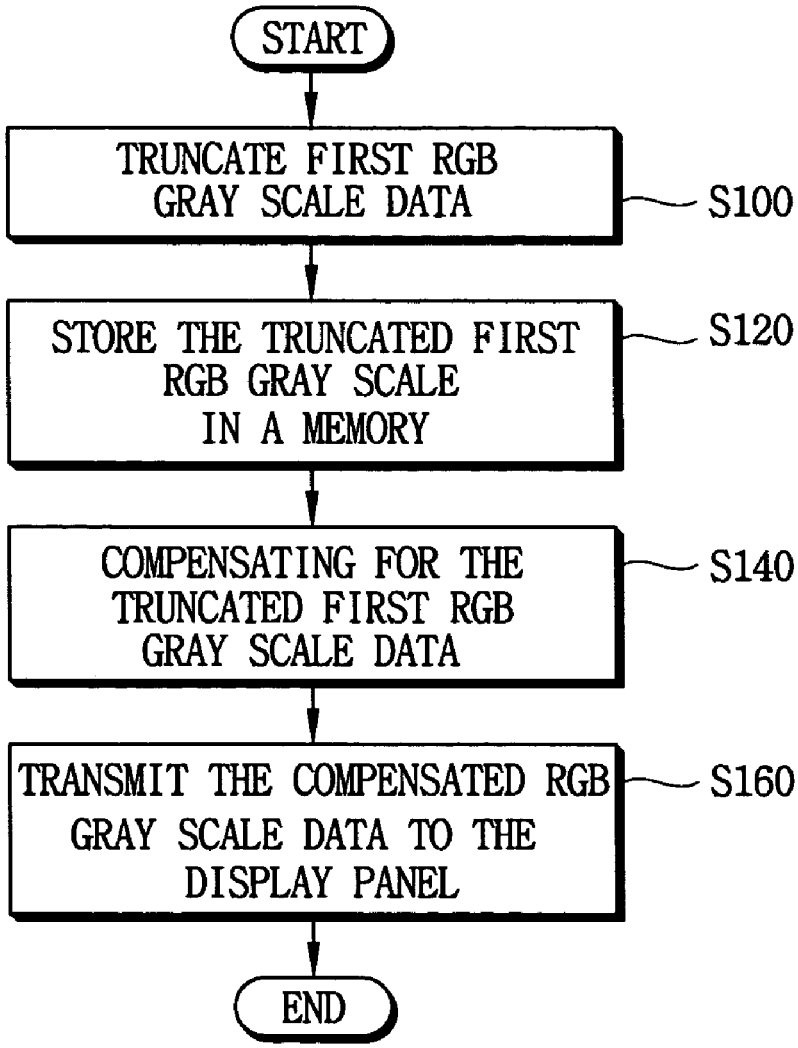
FIG. 9 is a flowchart illustrating a method of restoring RGB gray scale data according to an exemplary embodiment of the present invention.

FIG. 9 is a flowchart illustrating a method of restoring RGB gray scale data according to an exemplary embodiment of the present invention.

Referring to FIG. 9, the bit truncating section 10 truncates (S100) at least one bit of the first RGB gray scale data, and the truncated first RGB gray scale data is stored (S120) in the memory 30.

Next, the bit restoring section 50 compensates (S140) for the truncated first RGB gray scale data, thereby restoring a bit number of the truncated first RGB gray scale data. As a result, the third RGB gray scale data having the restored bit number is generated, and then transmitted (S160) to the display panel.

Figure 10:
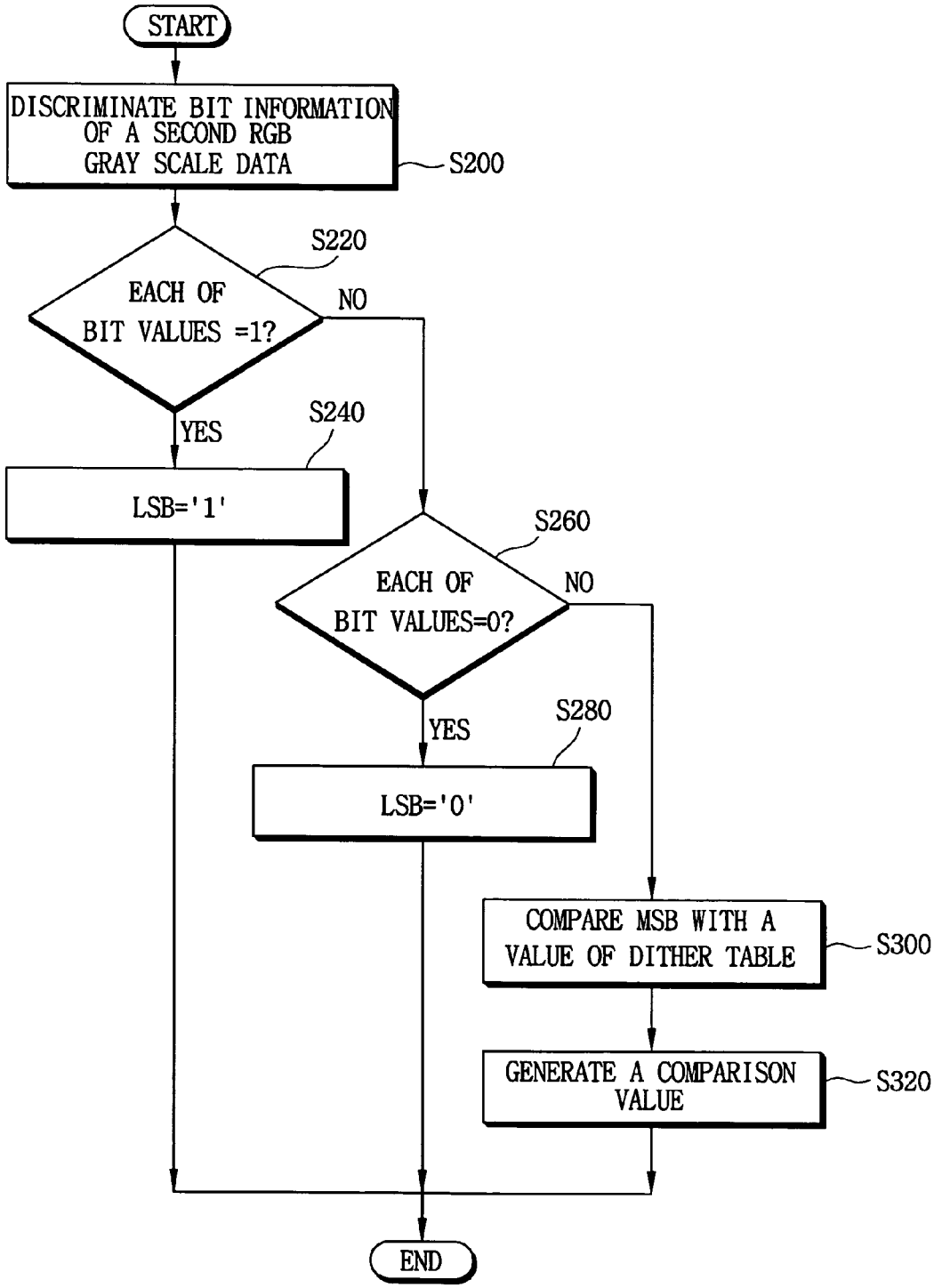
FIG. 10 is a flowchart illustrating a method of compensating for RGB gray scale data according to an embodiment of the present invention.

FIG. 10 is a flowchart illustrating a method of compensating for RGB gray scale data using bit information according to an embodiment of the present invention.

Referring to FIG. 10, the data discriminating section 300 discriminates (S200) bit information of the second RGB gray scale data. Particularly, the data discriminating section 300 discriminates (S220) whether each of bit values of 5 bits (for example, R5~R1) of the second RGB gray scale data has a binary value '1'. For example, the data discriminating section 300 discriminates whether R5~R1 have binary value '11111' or '00000'. When each of bit values of 5 bits of the second RGB gray scale data has the binary value '1', the value of the LSB of the third RGB gray scale data has (S240) the binary value '1' since the MSB of the second RGB gray scale data has a binary value '1'.

When the values of 5 bits of the second RGB gray scale data include a value different from the binary value '1', the data discriminating section 300 discriminates (S260) whether each of bit values of the 5 bits of the second RGB gray scale data has a binary value '0'.

When each of bit values of 5 bits of the second RGB gray scale data has a binary value '0', the value of the LSB of the third RGB gray scale data has (S280) the binary value '0' since the MSB of the second RGB gray scale data has a binary value '0'.

When the values of 5 bits of the second RGB gray scale data include a value different from the binary value '0', the MSB of the second RGB gray scale data is compared (S300) with a value of the dither table, and a comparison value is generated (S320) based on the comparison result.

Particularly, when the comparison value has a binary value '1', the LSB of the third RGB gray scale data has the binary value '1'. Whereas, when the comparison value has a binary value '0', the LSB of the third RGB gray scale data has the binary value '0'.

Figure 11:
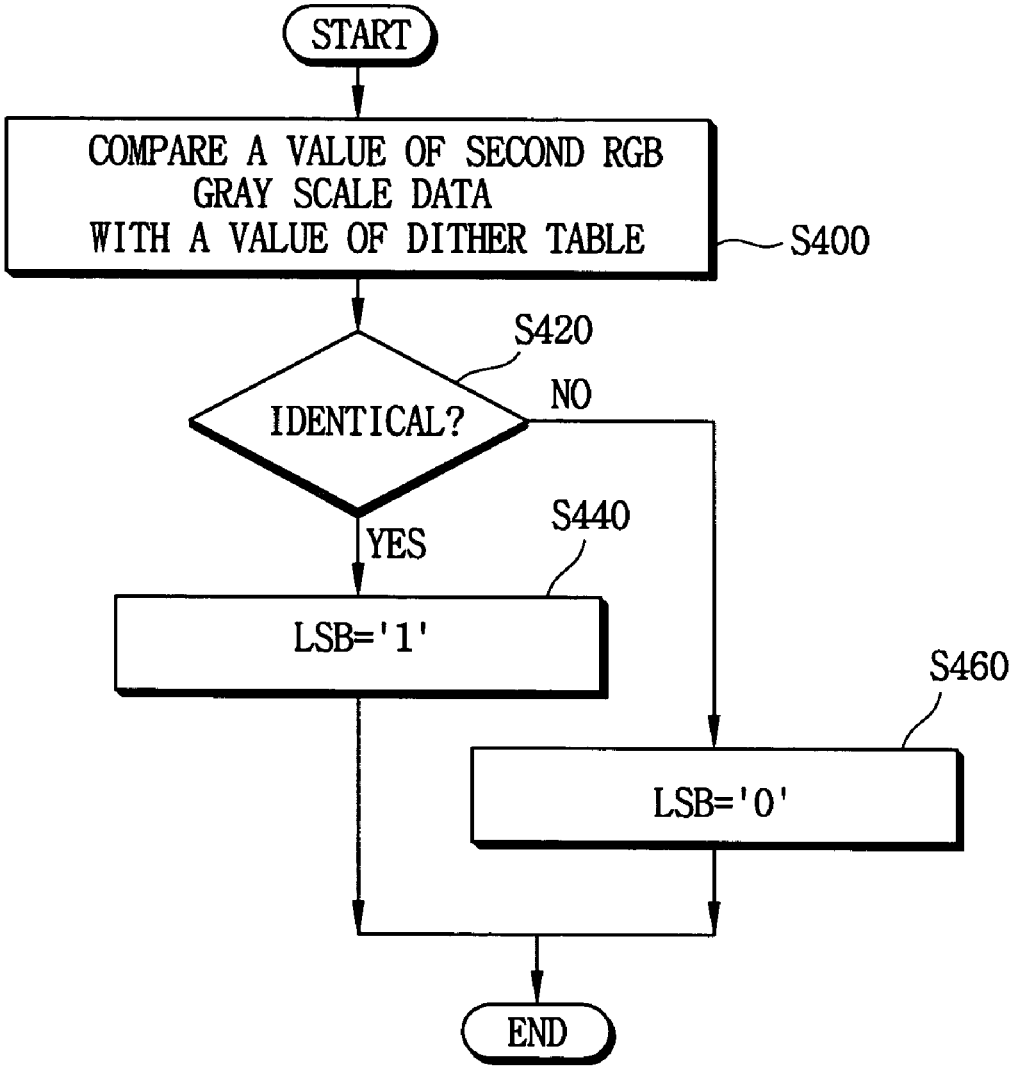
FIG. 11 is a flowchart illustrating a method of comparing a MSB of second RGB gray scale data with a dither table according to an exemplary embodiment of the present invention.

FIG. 11 is a flowchart illustrating a method of compensating for RGB gray scale data using a dither table according to an exemplary embodiment of the present invention.

Referring to FIG. 11, the comparing section 240 compares (S400) the value of the second RGB gray scale data with a value of the dither table.

Next, the comparing section 240 discriminates (S420) whether the value of the second RGB gray scale data is substantially identical to the value of the dither table in accordance with the comparison result.

When the value of the second RGB gray scale data is substantially identical to the value of the dither table, the LSB of the third RGB gray scale data has (S440) a binary value '1'.

Next, when the value of the second RGB gray scale data is not identical to the value of the dither table, the LSB of the third RGB gray scale data has (S460) a binary value '0'.

Having thus described exemplary embodiments of the present invention, it is to be understood that the invention defined by the appended claims is not to be limited by particular details set forth in the above description as many apparent variations thereof are possible without departing from the spirit or scope thereof as hereinafter claimed.

What is claimed is:

1. A method of restoring RGB (Red Green Blue) gray scale data comprising:

truncating the RGB gray scale data having M bits to generate a first RGB gray scale data having N bits, M being a positive integer and N being an integer less than M;

generating a RGB gray scale data information based on a bit discrimination information of the first RGB gray scale data, the bit discrimination information indicating whether a bit value of at least one bit of a color of the first RGB gray scale data is different from other bit values of the color; and when the bit discrimination information indicates that the bit value is different, comparing a bit value of a MSB (most significant bit) of the color of the first RGB gray scale data with a value of a dither table to generate a comparison value; and compensating for the first RGB gray scale data based on the RGB gray scale data information and the comparison value to generate a second RGB gray scale data.

2. The method of claim 1, wherein the second RGB gray scale data corresponds to the compensated first RGB gray scale data having M bits.

3. The method of claim 1, wherein M is 18, and N is 16.

4. The method of claim 3, wherein each bit number of a second data and a third data of the first RGB gray scale data is five, and each bit number of a fourth data and a fifth data of the second RGB gray scale data is six, the second data corresponding to a red color of the first RGB gray scale data, the third data corresponding to a blue color of the first RGB gray scale data, the fourth data corresponding to a red color of the second RGB gray scale data, and the fifth data corresponding to a blue color of the second RGB gray scale data.

5. The method of claim 1, wherein when each bit value of a first data corresponding to a first color of the first RGB gray scale data has a binary value '1', a bit value of an LSB (least significant bit) of the first data corresponding to a first color of the second RGB gray scale data has the binary value '1'.

6. The method of claim 5, wherein when each bit value of the first data corresponding to the first color of the first RGB gray scale data has a binary value '0', the bit value of the LSB of the first data corresponding to the first color of the second RGB gray scale data has the binary value '0'.

7. The method of claim 1, further comprising:

generating the dither table.

8. The method of claim 7, wherein generating the dither table comprises generating the dither table based on an address of a memory.

9. The method of claim 1, wherein the comparison value is a binary value '1' when the bit value of the MSB of the first RGB gray scale data is substantially identical to the value of the dither table.

10. The method of claim 9, wherein the comparison value is a binary value '0' when the bit value of the MSB of the first RGB gray scale data is different from the value of the dither table.

11. A method of restoring RGB gray scale data comprising:

truncating a first RGB gray scale data having M bits to generate a second RGB gray scale data having N bits, M being a positive integer and N being an integer less than M;

storing the second RGB gray scale data;

generating a RGB gray scale data information based on a bit information of the second gray scale data;

comparing a bit value of a MSB (most significant bit) of a color of the second RGB gray scale data with a value of a dither table based on the RGB gray scale data information to generate a comparison value, when a bit value of at least one bit of the color of the second RGB gray scale data is different from other bit values of the second RGB gray scale data; and compensating for the second RGB gray scale data based on the RGB gray scale data information and the comparison value to generate a third RGB gray scale data.

12. The method of claim 11, further comprising: generating the dither table.

13. The method of claim 12, wherein generating the dither table comprises generating the dither table based on an address of a memory.

14. The method of claim 11, wherein the third RGB gray scale data corresponds to the compensated second RGB gray scale data having M bits.

15. The method of claim 11, wherein M is 18, and N is 16.

16. The method of claim 15, wherein each bit number of a second data and a third data of the second RGB gray scale data is five, the second data corresponding to a red color of the second RGB gray scale data, and the third data corresponding to a blue color of the second RGB gray scale data.

17. The method of claim 11, wherein a bit value of an LSB of the third RGB gray scale data has a binary value '1' when each bit value of the second RGB gray scale data has a binary value '1'.

18. The method of claim 17, wherein the bit value of the LSB of the third RGB gray scale data has a binary value '0' when each bit value of the second RGB gray scale data has a binary value '0'.

19. The method of claim 11, wherein the comparison value has a binary value '1' when the bit value of the MSB of the second RGB gray scale data is substantially identical to the value of the dither table.

20. The method of claim 11, wherein the comparison value has a binary value '0' when the bit value of the MSB of the second RGB gray scale data is different from the value of the dither table.

21. An apparatus for restoring RGB gray scale data comprising:

a data input section configured to generate a RGB gray scale data information based on a bit information of a first RGB gray scale data having N bits, the first RGB gray scale data being obtained by truncating RGB gray scale data having M bits, M being a positive integer and N being an integer less than M;

a comparing section configured to compare a MSB of the first RGB gray scale data with a value of a dither table based on the RGB gray scale data information to generate a comparison value; and a data restoring section configured to compensate for the first RGB gray scale data based on the RGB gray scale data information and the comparison value to restore a bit number of the first RGB gray scale data to generate a second RGB gray scale data having M bits.

22. The apparatus of claim 21, further comprising a dithering section with information about the dither table.

23. The apparatus of claim 22, wherein the dithering section generates the dither table based on an address of a memory.

24. The apparatus of claim 21, wherein the data input section comprises:

a data discriminating section that discriminates a bit information of the first RGB gray scale data by discriminating whether each bit of a first data corresponding to a first color of the first RGB gray scale data has a binary value '1' or a binary value '0'; and a data information transmitting section that transmits the RGB gray scale data information.

25. The apparatus of claim 24, wherein when each bit value of the first data corresponding to the first color of the first RGB gray scale data has a binary value '1', a bit value of an LSB of the first data corresponding to the first color of the second RGB gray scale data has the binary value '1'.

26. The apparatus of claim 25, wherein when each bit value of the first data corresponding to the first color of the first RGB gray scale data has a binary value '0', a bit value of the LSB of the first data corresponding to the first color of the second RGB gray scale data has the binary value '0'.

27. The apparatus of claim 21, wherein M is 18, and N is 16.

28. The apparatus of claim 27, wherein each bit number of a second data and a third data of the second RGB gray scale data is five, the second data corresponding to a red color, and the third data corresponding to and a blue color.

29. The apparatus of claim 21, wherein the comparison value is a binary value '1' when the value of the MSB of the first RGB gray scale data is substantially identical to the value of the dither table.

30. The apparatus of claim 29, wherein the comparison value is a binary value '0' when the value of the MSB of the first RGB gray scale data is different from the value of the dither table.

31. An apparatus for restoring RGB gray scale data comprising:

a bit truncating section configured to truncate a first RGB gray scale data having M bits to generate a second RGB gray scale data having N bits, M being a positive integer, and N being an integer less than M;

a memory configured to store the second RGB gray scale data; and a bit restoring section configured to generate a RGB gray scale data information based on a bit information of the second RGB gray scale data, configured to generate a comparison value by comparing a MSB of the second RGB gray scale data with a value of a dither table, and configured to compensate for the second RGB gray scale data based on the RGB gray scale data information and the comparison value to generate a third RGB gray scale data having M bits.

32. The apparatus of claim 31, wherein the dither table is generated based on an address of a memory.

33. The apparatus of claim 31, wherein when each bit value of a first data corresponding to a first color of the first RGB gray scale data has a binary value '1', a bit value of an LSB of the first data corresponding to the first color of the second RGB gray scale data has the binary value '1'.

34. The apparatus of claim 33, wherein when each bit value of the first data corresponding to the first color of the first RGB gray scale data has a binary value '0', the bit value of the LSB of the first data corresponding to the first color of the second RGB gray scale data has the binary value '0'.

35. The apparatus of claim 31, wherein M is 18, and N is 16.

36. The apparatus of claim 35, wherein each bit number of a second data and a third data of the second RGB gray scale data is five, the second data corresponding to a red color, and the third data corresponding a blue color.

37. The apparatus of claim 31, wherein the comparison value is a binary value '1' when the bit value of the MSB of the second RGB gray scale data is substantially identical to the value of the dither table.

38. The apparatus of claim 31, wherein the comparison value is a binary value '0' when the bit value of the MSB of the second RGB gray scale data is different from the value of the dither table.

* * * * *